United States Patent [19]

Smith

[11] Patent Number: 4,782,780

[45] Date of Patent: Nov. 8, 1988

[54] SAILBOARD BOOMS

[75] Inventor: Dennis M. Smith, Claremont, Australia

[73] Assignee: Smitech Pty. Ltd., Australia

[21] Appl. No.: 61,344

[22] PCT Filed: Aug. 19, 1986

[86] PCT No.: PCT/AU86/00241

§ 371 Date: Apr. 21, 1987

§ 102(e) Date: Apr. 21, 1987

[87] PCT Pub. No.: WO87/01086

PCT Pub. Date: Feb. 26, 1987

[30] Foreign Application Priority Data

Aug. 22, 1985 [AU] Australia ..... PH2048

[51] Int. Cl.[4] ..... B63B 15/00

[52] U.S. Cl. ..... 114/98; 114/39.2; 114/102

[58] Field of Search ..... 114/39.2, 102, 97, 98

[56] References Cited

FOREIGN PATENT DOCUMENTS 2821263 11/1979 Fed. Rep. of Germany ..... 114/98

2855556 7/1980 Fed. Rep. of Germany ..... 114/98

*Primary Examiner*—Sherman D. Basinger

*Assistant Examiner*—Jesûs D. Sotelo

*Attorney, Agent, or Firm*—Handal & Morofsky

[57] ABSTRACT

A mast end boom mounting (10) for a sailing craft comprising a pair of members (11 and 12) hingedly interconnected and shaped to encompass a mast in closely abutting relationship, at least one of the members (11 and 12) being adapted to be mounted to the boom; locking element (17) is provided to engage both members and retain them in close abutting relationship with the mast.

17 Claims, 3 Drawing Sheets

SAILBOARD BOOMS

This Invention relates to sailing boats and in particular the sail booms used with sail craft.

In one form the invention resides in a mast end boom mounting for a sailing craft comprising a pair of members hingedly interconnected and shaped to encompass a mast in closely abutting relationship, at least one of said members being adapted to be mounted to said boom, locking means provided to engage both members and retain them in close abutting relationship with the mast.

According to a preferred feature of the invention said hingeable connection is capable of disengagement.

According to a further preferred feature of the invention said locking means is provided between said members in opposed relation to the hinged interconnection.

According to a further preferred feature of the invention said hinged interconnection comprises a substantially radially directed protrusion on one member receivable in a socket provided on the other member.

According to a further preferred feature of the invention said locking means comprises a locking member engageable with each member.

According to a preferred feature of the previous feature the locking member is pivotally supported from one member and is engagable over an abuttment provided on the other member.

According to a preferred feature of the invention a resilient cushioning material is provided on the opposed faces of the members.

According to a preferred feature of the invention each member is adapted to receive one end of one side of wishbone boom.

According to another form the invention resides in a wishbone boom having a mast end boom mounting of the form described above.

According to a preferred feature of the invention the outer end of the boom comprises a clew end fitting comprising a pair of members pivotally interconnected and each adapted to engage a side member of the boom.

The invention will be more fully understood in the light of the following description of one specific embodiment. The description is made with reference to the accompanying drawings of which:

The embodiment is directed to wishbone booms for use with sailboards. The boom of a sailboard is secured to a mast at about shoulder height and comprises a pair of curved tubes which extend to each side of the sail. The tubes are interconnected at their outer end by a clew end fitting. The boom end of the tubes are interconnected by a mast end fitting. The mast end fitting is generally fixed to the mast by a length of rope which has several disadvantages including:

(a) It is difficult to tie the rope tightly enough to prevent movement between the boom and mast about axial and transverse axes of the mast.

(b) The rope has a tendancy to stretch or loosen during use to cause the boom to move forward on the mast and thus reduce the clew tension on the sail.

(c) The fitting is bulky which can be detrimental to performance and handling.

In addition means have been provided to wedge the mast end of the boom against the mast to prevent movement therebetwen. Such an arrangement however have produced differential loads on the mast section which have lead to the crushing of the mast. In addition, they have caused excessive wear of the mast.

The embodiment is intended to overcome the above-mentioned disadvantages.

Figure 1:
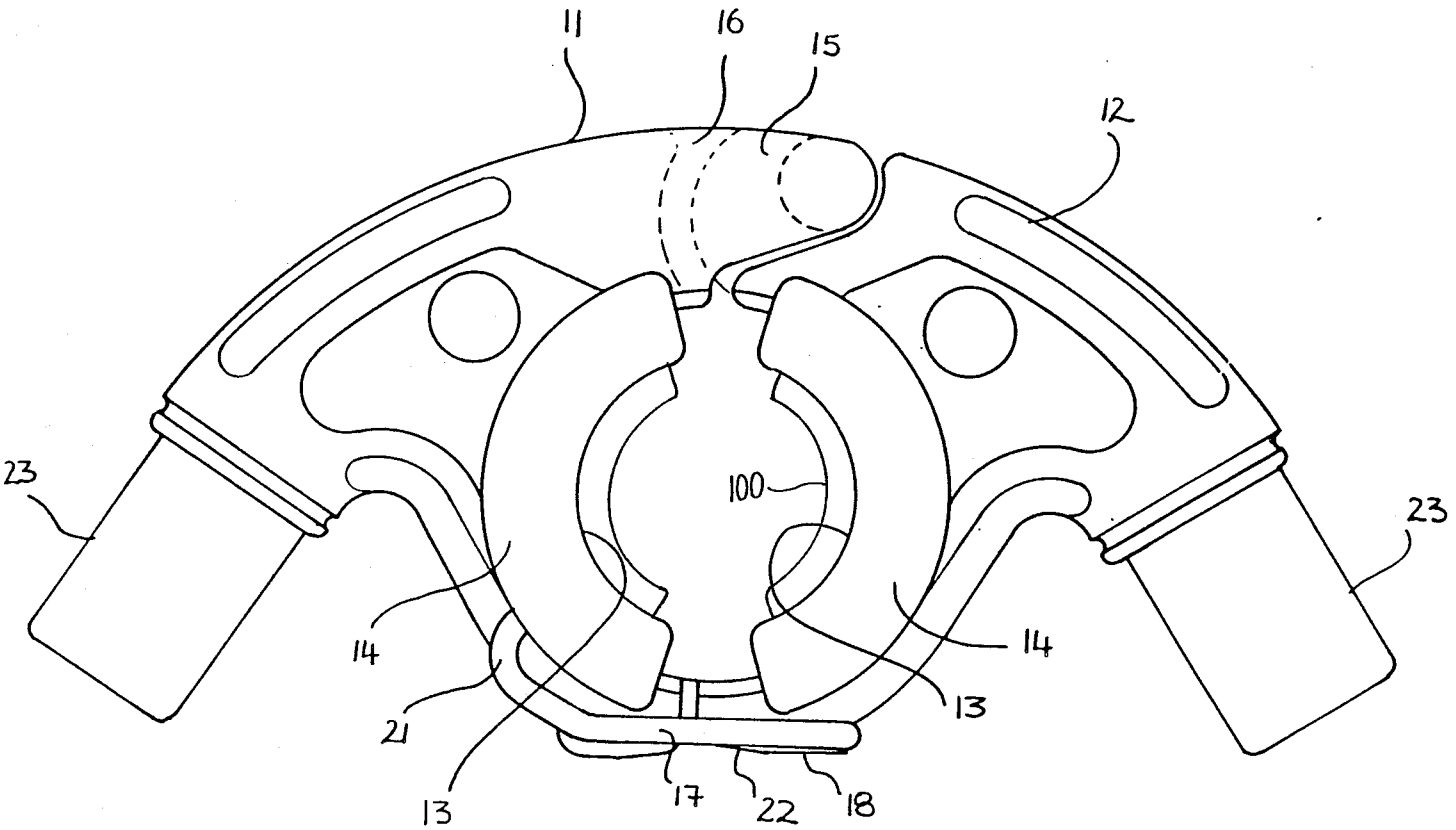
FIG. 1 is a plan view of the boom mounting of the embodiment.
Figure 2:
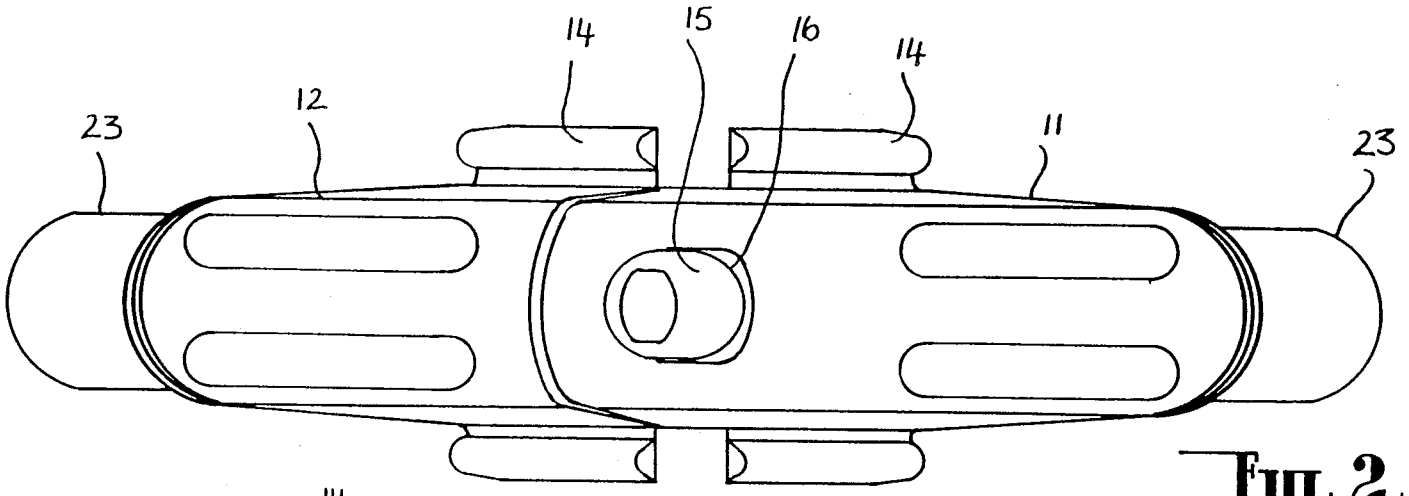
FIG. 2 is a front elevation of the embodiment.
Figure 3:
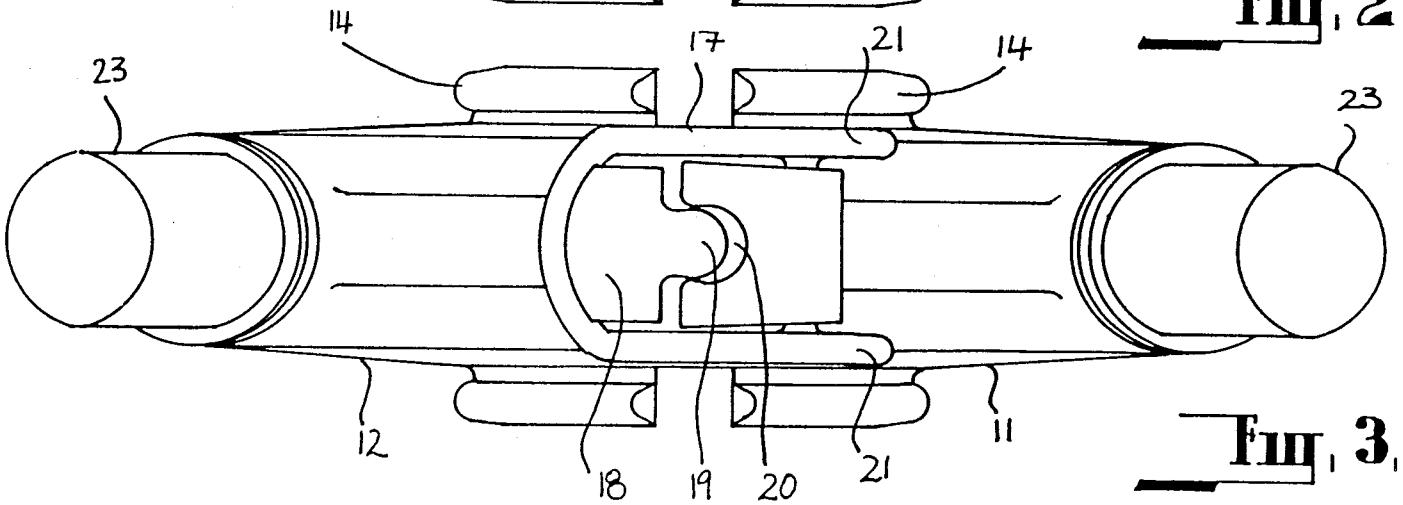
FIG. 3 is a rear elevation of the embodiment.
Figure 4:
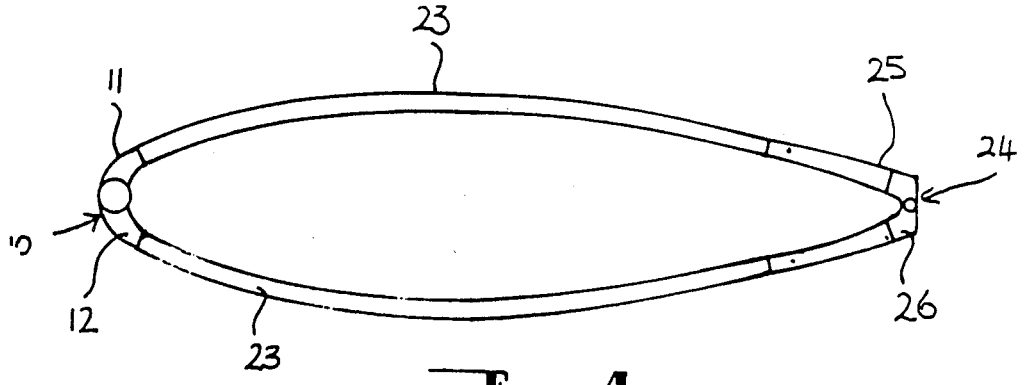
FIG. 4 is a plan view of a boom according to the embodiment.

The embodiment utilises a mast end boom mounting 10 as shown as FIGS. 1, 2 and 3. The mounting 10 comprises a pair of members 11 and 12 which together define a complementary inner surface 13 which encompasses the mast (not shown). The inner surface 13 is provided by substantially semi-annular cushioning members 14 supported by the respective members formed of a resilient cushioning material which will grip the surface of the mast to prevent movement of the boom on the mast when engaged with the mast. To enhance the frictional resistance to movement of the boom along the mast the inner faces 13 of the cushioning members 14 are formed with a set of parallel circumferential ribs (not shown).

The members 11 and 12 are adapted to be hingedly interconnected. The hinged interconnection is achieved through a socket 16 on one member 11 which receives a substantially radial protrusion 15 provided on the other member 12. The radial protrusion 15 is formed to have an arcuate configuration to ensure maintenance of the interengagement between the members when in the closed position.

A locking means is provided on the members remote from the hinged interconnection. The locking means comprises a locking member 17 pivotally supported on the one member 11 and formed with a loop which is receivable over an abuttment 18 on the one member 12 whereby when the locking member 17 is engaged over the abutment 18 the members are in their closed position at which they snugly engage the mast. The locking means further comprises a longitudinal protrusion 19 on the other member 12 which is receivable in a correspondingly shaped recess 20 on the other member 11. The interengagement between the longitudinal protrusion 19 and the recess 20 prevents relative axial displacement between the members 11 and 12. In addition the nett affect of the hingeable connection through the socket 16 and the radial protrusion 15 and the interengagement of the longitudinal protrusion 19 in the recess, is to provide for relative pivotable movement between the members 11 and 12 about a diametric axis between hinged interconnection and locking means. Such pivotable movement will occur in use due to differential loadings on the sides of the boom and serves in increasing the clamping engagement between the members and the mast to prevent movement of the boom on the mast.

The portion of the locking member 17 remote from the loop shaped portion is formed with a hook shaped extension 21 to each side of the locking member. The ends of the hook shaped extensions 21 are in abutting relationship with the outer face of the semi-annular cushioning member 14 on the other member. This engagement provides a biassing force on the locking member 17 to hold it in a position at which the loop occupy when in engagement with the abuttment 18 on the other member 12. The outer surface 22 of the longitudinal protrusion 19 of the other member 12 is shaped such that on the members being pivotted to the closed position the loop portion of the locking member will ride over the outer surface 22 and become engaged over the abuttment 18.

Each member 11 and 12 is adapted to engage one end of one tube 12 of a wishbone boom. The interconnection may be of a rigid form or alternatively the tubes may be slidably receivable over or within an axial extension of the member to facilitate dismantling of the boom. The clew end of the boom is formed by a clew end mounting 24 comprising a pair of members 25 and 26 pivotally interconnected about an axis parallel with the hinged connection of the mast end boom mounting 10. The members are slidably received over or within the other ends of the tubes 23.

As a result of the construction of the boom of the embodiment it is possible to vary the length of the boom by replacing the tubes 23 by others of a differing length. On fixing a sail to the boom the tension applied along the foot of the sail holds the mast end fitting and clew end fitting in engagement with the ends of the tubes 23.

It should be appreciated that the scope of the invention need not be restricted to the particular scope of the embodiment described above. In particular the invention need not be restricted to sailboards but is applicable to any other form of sail craft utilising a mast and boom to support the sail. In addition the embodiment need not be restricted to use with a wishbone boom.

The claims defining the invention are claimed as follows:

1. A mast end boom fitting for a sailing craft, comprising:

(a) a first member having respective first and second sides;

(b) a second member having respective first and second sides, said second member being hingedly interconnected at its first side to the first side of said first member;

(c) locking means for securing said first member to said second member and to cause said first and second members to clampingly engage said mast, said locking means secured to said first member at its respective second side and secured to said second member at its respective second side, said first member, said second member and said locking means together configured and dimensioned to together define an opening encompassing said mast within said opening in close abutting relationship, at least one of said members being adapted to be mounted to one end of a boom.

2. A mast end boom fitting as in claim 1 wherein said hinged interconnection between said first and second member is capable of disconnection.

3. A mast end boom fitting as in claim 2 wherein said hinged interconnection and locking means provide some relative pivotal movement between the first and second members about a diametric axis.

4. A mast end boom fitting as in claim 3 wherein said hinged interconnection is provided by a substantially radially directed protrusion on one member receivable in a socket defined by the other member.

5. A mast end boom fitting as in claim 2 wherein the locking means comprises:

(d) a locking member pivotally supported from one member; and (e) an abutment provided on the other member, said abutment being engageable by the locking member to maintain the members in clamping engagement with the mast.

6. A mast end boom fitting as in claim 1 wherein the locking means comprises:

(d) a locking member pivotally supported from one member; and (e) an abutment provided on the other member and positioned, configured and dimensioned to be engaged by the locking member when the members are in clamping engagement with the mast.

7. A mast end boom fitting as in claim 6 wherein said first and second members define complementary opposed faces adapted to frictionally engage the mast to resist movement of the boom along the mast.

8. A mast end boom fitting as in 7 wherein a resilient cushioning member is provided on said opposed complementary faces.

9. A mast end boom fitting as in claim 8 wherein the inner face of the cushioning member is formed with a set of parallel circumferential ribs.

10. A mast end boom fitting as in claim 8 wherein said locking means bears against a portion of the cushioning member on said first member to be biased thereby to a position at which it will be engaged with said abutment.

11. A mast end boom fitting as in claim 6, in combination with a wishbone boom attached to said fitting and wherein the outer end of the boom comprises a clew end fitting comprising a pair of clew members pivotally interconnected and each adapted to engage a side member of the boom.

12. A mast end boom fitting as in claim 1 wherein said locking means bears against a portion of the cushioning member on said first member to be biased to a position at which it will be engaged with said abutment.

13. A most end boom fitting as in claim 1, in combination with a boom having inner and outer ends and attached at its inner end to said boom fitting.

14. A mast end boom fitting as in claim 13 wherein said boom comprises two side members and the outer end of the boom comprises a clew end fitting comprising a pair of clew members pivotally interconnected and each adapted to engage a respective one of said side members of the boom.

15. A mast end boom fitting for a sailing craft, comprising:

(a) a first member having respective first and second sides and adapted to receive one end of one side of a wishbone boom;

(b) a second member having respective first and second sides and adapted to receive one end of one side of a wishbone boom, said second member being hinged interconnected at its first side to the first side of said first member;

(c) locking means for securing said first member to said second member and to cause said first and second members to clampingly engage said mast, said locking means secured to said first member at its respective second side and secured to said second member at its respective second side, said first and second members being configured to together define an opening which will substantially encompass a mast in close abutting relationship.

16. A mast end boom fitting as in claim 15 in combination with a wishbone boom attached to said fitting.

17. A sailing craft, comprising:

(a) a board;

(b) a mast supported for movement about said board;

(c) a boom comprising:

(i) a first member having respective first and second sides;

(ii) a second member having respective first and second sides, said second member being hingedly interconnected at its first side to the first side of said first member, said first and second members being configured together define an opening which will substantially encompass said mast in close abutting relationship;

(iii) locking means for securing said first member to said second member and to cause said first and second members to clampingly engage said mast, said locking means secured to said first member at it respective second side and secured to said second member at its respective second side, said first member, said second member and said locking means together configured and dimensioned to encompass said mast within said opening, at least one of said members being adapted to be mounted to one end of said boom.

* * * * *